US005940929A

United States Patent [19]

Berg

[11] Patent Number: 5,940,929

[45] Date of Patent: Aug. 24, 1999

[54] SURFACE MAINTENANCE MACHINE WITH IMPROVED DUST COLLECTION SYSTEM

[75] Inventor: David W. Berg, Plymouth, Minn.

[73] Assignee: Tennant Company, Minneapolis, Minn.

[21] Appl. No.: 08/880,225

[22] Filed: Jun. 23, 1997

[51] Int. Cl.[6] ..... A47L 11/204

[52] U.S. Cl. ..... 15/334; 15/349

[58] Field of Search ..... 15/331, 334, 349

[56] References Cited

U.S. PATENT DOCUMENTS

| | | | |
|---|---|---|---|
| 3,173,777 | 3/1965 | Tamny . | |
| 3,670,359 | 6/1972 | Gutbrod . | |
| 4,310,944 | 1/1982 | Kroll et al. | 15/349 X |
| 4,429,432 | 2/1984 | Copeland et al. . | |
| 4,514,875 | 5/1985 | Comer | 15/349 |
| 5,018,240 | 5/1991 | Holman . | |
| 5,303,448 | 4/1994 | Hennessey et al. | 15/349 X |
| 5,659,921 | 8/1997 | Narayan | 15/349 |
| 5,797,162 | 8/1998 | Vystreil et al. | 15/334 X |

FOREIGN PATENT DOCUMENTS

| | | | |
|---|---|---|---|
| 1208457 | 1/1966 | Germany | 15/334 |

*Primary Examiner*—Chris K. Moore

*Attorney, Agent, or Firm*—Dorn, McEachran, Jambor & Keating

[57] ABSTRACT

A surface maintenance machine for use in sweeping and collecting dust and debris from inside and outside areas has a frame and wheels for supporting the frame for movement along the surface to be cleaned. There is a debris hopper on the frame and a rotary sweeping brush on the frame mounted to direct dust and debris from sweeping a surface into the hopper. A vacuum fan is located on the frame and there is an air flow path on the frame from the hopper to the vacuum fan. A dust collection container in the form of a flexible bag is positioned within a vacuum chamber in said air flow path and is in a generally upright disposition. The dust collection container has an air flow entrance adjacent the upper end thereof. During operation of the sweeping brush, dust and debris are directed into the hopper, with the vacuum fan moving dust from the hopper along the air flow path to the dust collection upper air inlet with the debris remaining in the hopper.

6 Claims, 3 Drawing Sheets

Fig.3.
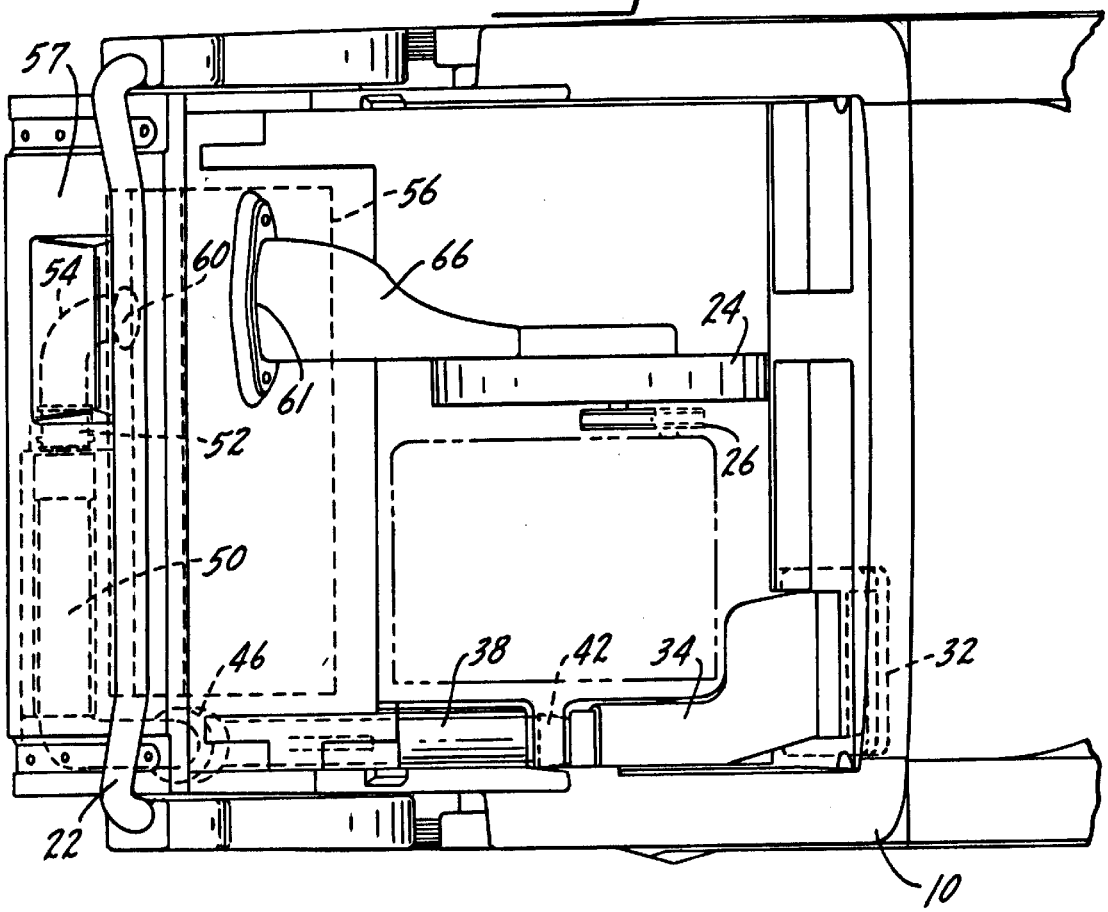
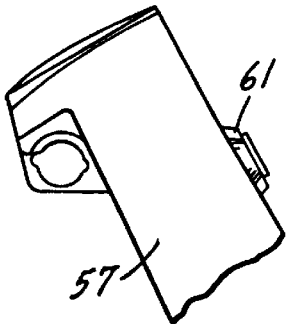
Fig.4.
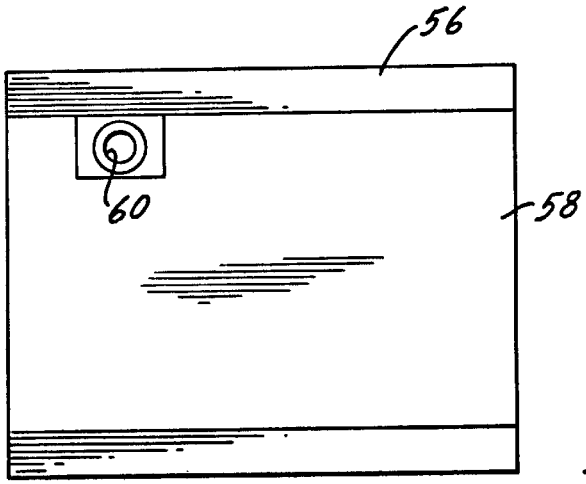
Fig.5.
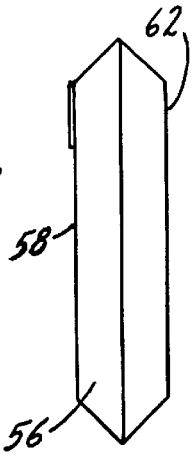
Fig.6.

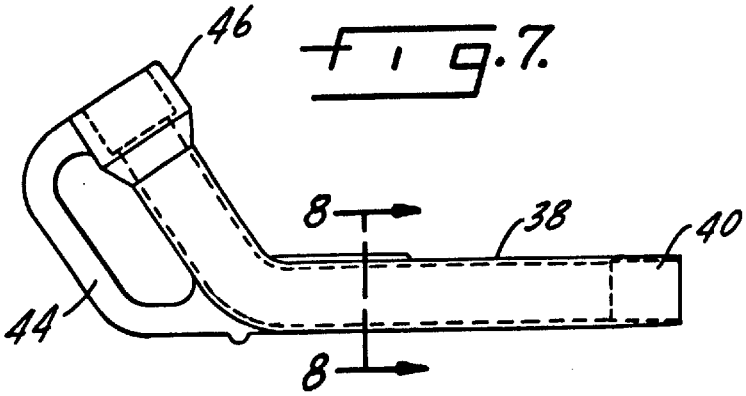
Fig. 7.
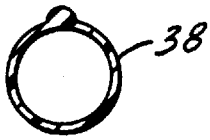
Fig. 8.
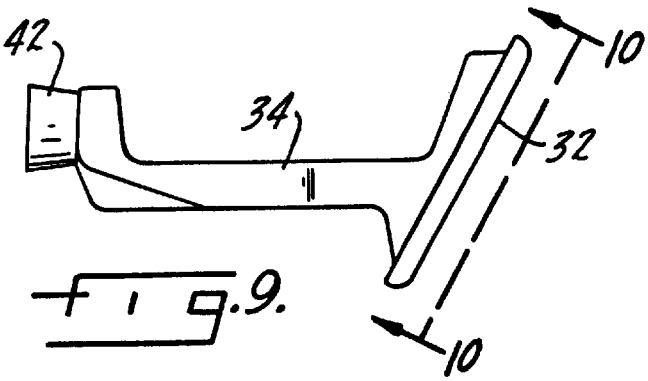
Fig. 9.
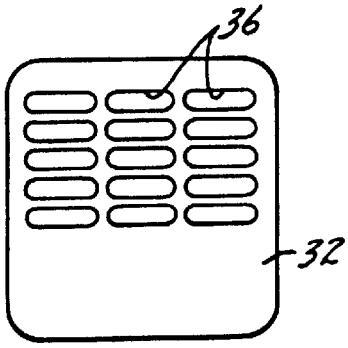
Fig. 10.
Fig. 11.
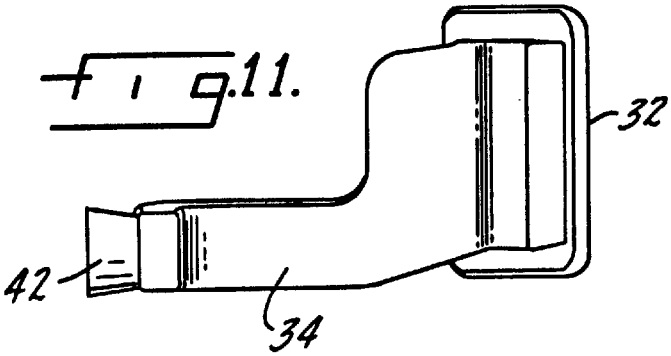

SURFACE MAINTENANCE MACHINE WITH IMPROVED DUST COLLECTION SYSTEM

THE FIELD OF THE INVENTION

The present invention relates to sweeping machines which may be used in outdoor areas such as parking lots or sidewalks as well as in certain indoor areas such as factory buildings, office corridors and the like. It particularly relates to an improved dust collection system for such a sweeper. Sweepers of the general type disclosed herein are manufactured by Tennant Company of Minneapolis, Minn. and conventionally have a rotary sweeping brush and one or more side sweeping brushes which are used to direct dust and debris towards the main cylindrical rotary brush during use. The machine may either be battery driven, or have its own gasoline powered motor. It may be a walk behind machine or the driver may ride it.

What is important in the present invention is the specific dust collection system which insures that the debris which is swept up will remain in the debris hopper and the dust will be conveyed through an air flow path by a vacuum fan to a dust collection container. In particular the dust collection container is located in an upright position in a vacuum chamber, may be a flexible bag and has the entrance thereto adjacent its upper end. As a part of the air flow path there is a wand which includes a collapsible hose. The wand may be removed or pulled out of the sweeper and used as an independent collector of dust and debris. The wand may be used without the necessity of closing baffles or any separate activation.

SUMMARY OF THE INVENTION

The present invention relates to sweeping machines for surface maintenance and in particular to an improved dust collection system for such a sweeping machine. A primary purpose of the invention is a dust collection system for the described environment using a top entrance upright bag, positioned in a vacuum chamber, as a part of the dust collection system.

Another purpose is a sweeping machine as described in which the debris will be collected in a hopper and the dust will be conveyed by a vacuum fan through an air flow passage to a generally upright dust collection chamber.

Another purpose is a sweeper of the type described in which a portion of the air flow path is formed by a removable and collapsible hose, with the hose functioning as a vacuum wand without any separate activation.

Other purposes will appear in the ensuing specification, drawings and claims.

BRIEF DESCRIPTION OF THE DRAWINGS

The invention is illustrated diagrammatically in the following drawings wherein:

FIG. 3 is a partial top view of the sweeper of FIG. 2;

FIG. 4 is a partial side view illustrating the connection between the vacuum hose and the frame;

FIG. 5 is a rear view of the filter bag;

FIG. 6 is a side view of the filter bag;

FIG. 7 is a plan view of the removable wand;

FIG. 8 is a section along plane 8—8 of FIG. 7;

FIG. 9 is a plan view of the vacuum wand intake;

FIG. 10 is a front view along plane 10—10 of FIG. 9; and

FIG. 11 is a top view of the vacuum wand intake.

DESCRIPTION OF THE PREFERRED EMBODIMENT

The present invention relates to a sweeper using a vacuumized hopper for debris and a filter bag for light or airborne dust. As shown herein, the sweeper may be powered by a gasoline engine and it may be a walk behind machine. The invention should not be so limited as it is applicable to any type of sweeping machine in which there is a cylindrical brush directing dust and debris into a hopper, a vacuum fan and an air passage between the vacuum fan and the hopper.

Figure 1:
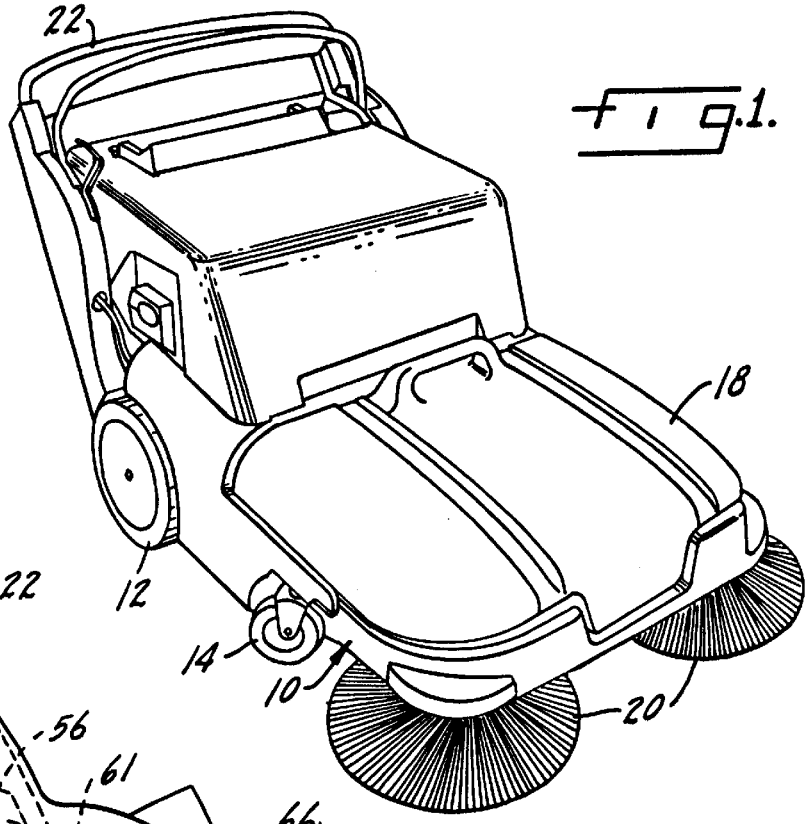
FIG. 1 is a front perspective view of a sweeping machine of the type described herein.
Figure 2:
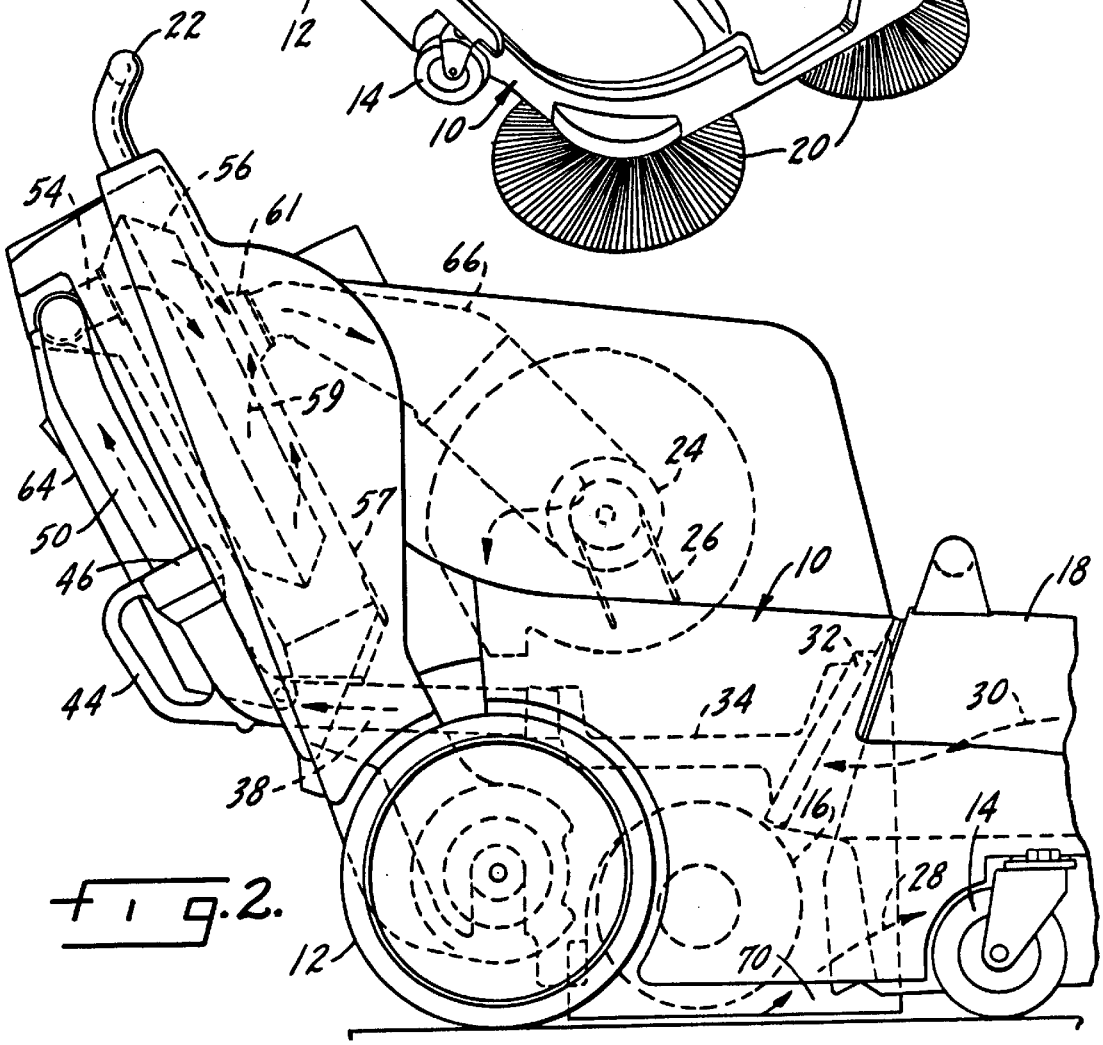
FIG. 2 is an enlarged partial side view of the sweeper of FIG. 1.

As illustrated in FIG. 1 the sweeper includes a frame indicated generally at 10 mounted on rear wheels 12 and with pivotal front wheels 14. There is a cylindrical brush 16 mounted beneath the sweeper which directs dust and debris from a surface being swept into a hopper indicated at 18. Only a portion of the hopper is shown in FIG. 2 and the hopper will extend forward of the pivotal wheels 14. At the front of the sweeper there may be two rotary sweeping brushes 20 which normally will direct dust and debris from the area in front of the sweeper to a position where it may be thrown by the cylindrical brush 16 into the hopper 18.

The sweeper may include a handle 22 for use by the operator and there will be other controls suitable for a sweeper of the type described.

A vacuum fan is indicated in dotted lines in FIG. 2 at 24 and may be driven by a belt 26. The vacuum fan 24 forms one end of an air passage or air system which draws air into the hopper 18 in the direction of arrows 28. The air will follow the direction of arrows 28 and then will reverse in direction within the hopper and will follow arrows 30 into the front end 32 of a wand intake 34. The wand intake 34 is particularly shown in FIGS. 9, 10 and 11 and may have a plurality of front air opening 36 which provide control of the volume of air moved from the hopper 18 through the air passage to be described. Thus, the cubic feet per minute of air and dust is limited by the number and size of the openings 36. The rear end of the wand intake 34 is connected to the wand 38 illustrated in FIGS. 7 and 8. The wand 38 may have a cylindrical end portion 40 which extends into a sleeve 42 at the rear end of the wand intake. This connection is separable as the wand 38 may be pulled away from the wand intake when sweeping wet areas so that no moisture is drawn into the filter bag.

The wand 38 may have a handle 44 for use by the operator when the wand is to be used independently of the brush to pick up dust and debris. The outlet end of wand 38, indicated at 46, is connected to a collapsible, flexible hose 50 which extends upwardly along the rear of the frame 10, as particularly shown in FIG. 3 and has a coupling 52 for connection to an elbow 54 which provides the inlet for the filter bag 56. The filter bag 56 is positioned within a vacuum chamber 57. As shown particularly in FIGS. 5 and 6, the filter bag 56 has a rear side 58 with an air inlet opening 60 adjacent the top thereof. It also has a front side 62, with air flowing through the front and rear sides in the path of arrows 59, from the filter bag to the vacuum chamber 57 and then to the vacuum fan 24. The vacuum chamber 57 has an outlet 61 connected to a conduit 66 which in turn is connected to fan 24. The filter bag may be made of any suitable flexible material and may be water resistant if desired. It is important to note that the inlet to the filter bag is adjacent the upper end thereof and that only light or airborne dust will be drawn into the filter bag with the heavy debris from the sweeping brush 16 remaining in the hopper 18.

The filter bag is removable from the vacuum chamber 57 through a sealed latched rear door 64 so the bag may be replaced when full. It is particularly advantageous to have the inlet to the filter bag adjacent the top so that the dust may fall by gravity down into the bottom of the bag and the bag need not be emptied until it is essentially full. Dusty air will enter the bag, the dust will fall down to the bottom of the bag and the air will pass through the front and rear surfaces of the bag, from the vacuum chamber, and along conduit 66 to the vacuum fan 24.

The sweeper may have molded side skirts indicated at 70 along the sides thereof which are effective to control the volume air and dust flowing underneath the sweeper and into the area of the brush 16. The distance between the bottom of the skirt 70 and the surface being swept is kept at a minimum so as to control the volume of dust and air which flows to the areas surrounding the brush and thus flows to the hopper and through the described dust collection system.

During use, the wand 38 may be removed from the wand intake 34 to either function as a separate dust collection tool or in those instances in which the brush is sweeping wet areas to eliminate the possibility of moisture reaching the filter bag. The wand 38 is connected to a collapsible, flexible hose 50 which enables the wand to be separately used and to provide a degree of extension to reach areas separate and apart from the location of the sweeping machine.

Of importance in the invention is the use of a filter bag within a vacuum chamber which is a part of the air flow system and in cooperation with the air control provided by the molded side skirts and openings 36 limits air flow volume so that only the lightest particles will be drawn into the filter bag, with debris and heavier particles remaining in the hopper. By using a filter bag which has a top entrance it is assured that the bag need not be emptied until it is substantially full. The bag is disposed in a generally upright position such that the dust will fall to the bottom of the bag by gravity as the air passes through the filter.

Whereas the preferred form of the invention has been shown and described herein, it should be realized that there may be many modifications, substitutions and alterations thereto.

The embodiments of the invention in which an exclusive property or privilege is claimed are defined as follows:

1. A surface maintenance machine including a frame, wheel for supporting said frame, a debris hopper on said frame, a rotary sweeping brush on said frame mounted to direct dust and debris from sweeping a surface into said hopper, a vacuum fan on said frame, an air flow path on said frame from said hopper to said vacuum fan, a vacuum chamber on said frame in said air flow path, an air flow conduit from said vacuum chamber to said fan, an elongated dust collection container positioned in a generally vertical disposition within said vacuum chamber, said dust collection container having an air flow entrance adjacent an upper end thereof, operation of said brush moving dust and debris into said hopper, with the vacuum fan moving dust along said air flow path to the dust collection container upper air inlet, with debris remaining in said hopper, said vacuum fan drawing air through said container, from said vacuum chamber to said fan, with dust falling downwardly in said container from said airflow entrance.

2. The surface maintenance machine of claim 1 wherein said dust collection container is a flexible bag having an air inlet at the top of one side thereof.

3. The surface maintenance machine of claim 1 including side skirts along said frame limiting air flow to said hopper.

4. A surface maintenance machine including a frame, wheels for supporting said frame, a debris hopper on said frame, a rotary sweeping brush on said frame mounted to direct dust and debris from sweeping a surface into said hopper, a vacuum fan on said frame, an air flow path on said frame from said hopper to said vacuum fan, a vacuum chamber on said frame in said air flow path, an air flow conduit from said vacuum chamber to said fan, a dust collection container positioned within said vacuum chamber, said dust collection container having an air flow entrance, operation of said brush moving dust and debris into said hopper, with the vacuum fan moving dust along said air flow path to the dust collection chamber air inlet, with debris remaining in said hopper, a down stream portion of said air flow path being disconnectable from an adjacent portion of said air flow path for use as a vacuum wand.

5. The surface maintenance machine of claim 4 wherein said air flow path includes a collapsible, flexible hose, and a wand being connected to one end of said hose.

6. The surface maintenance machine of claim 5 wherein said wand has a plurality of air flow control openings facing said hopper, with said air flow control openings limiting the volume of dust and air moving to said dust collection container.

* * * * *